United States Patent [19]

Bayder

[11] 4,003,147

[45] Jan. 18, 1977

[54] SHOE SHOELACE ACCESSORY

[75] Inventor: George J. Bayder, New York, N.Y.

[73] Assignee: The Raymond Lee Organization, Inc., New York, N.Y. ; a part interest

[22] Filed: May 27, 1975

[21] Appl. No.: 581,360

[52] U.S. Cl. ..... 36/136
[51] Int. Cl.[2] ..... A43B 23/00
[58] Field of Search ..... 36/1, 2.5 R, 2.5 Q, 36/136

[56] References Cited

UNITED STATES PATENTS

| | | | |
|---|---|---|---|
| 2,344,421 | 3/1944 | Schwartz | 36/2.5 Q |
| 2,904,901 | 9/1959 | Goldstein | 36/2.5 Q |
| 3,529,367 | 9/1970 | Brown | 36/1 |

*Primary Examiner*—Patrick D. Lawson
*Attorney, Agent, or Firm*—Daniel Jay Tick

[57] ABSTRACT

An openable container affixed to a shoe houses an extra shoelace.

2 Claims, 5 Drawing Figures

SHOE SHOELACE ACCESSORY

DESCRIPTION OF THE INVENTION

The present invention relates to a shoe shoelace accessory. More particularly, the invention relates to a shoe shoelace accessory for a shoe having a shoelace.

Objects of the invention are to provide a shoe shoelace accessory of simple structure, which is inexpensive in manufacture, readily affixed to new and used shoes of any style, and functions efficiently, effectively and reliably to provide a shoelace when needed, without affecting the esthetic beauty of the shoe.

In order that the invention may be readily carried into effect, it will now be described with reference to the accompanying drawing, wherein.

In the FIGS., the same components are identified by the same reference numerals.

Figure 3:
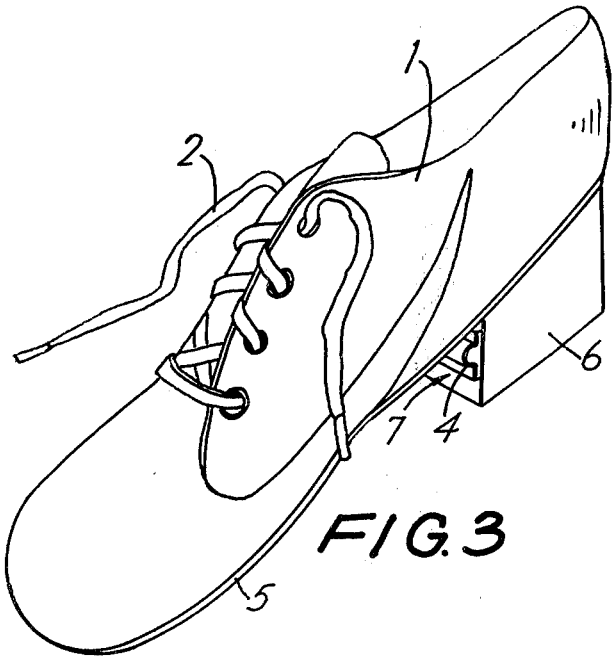
FIG. 3 is a perspective view of a shoe having an embodiment of the shoe shoelace accessory of the invention affixed thereto.

The shoe shoelace accessory of the invention is for a shoe 1 having a shoelace 2 (FIG. 3).

Figure 4:
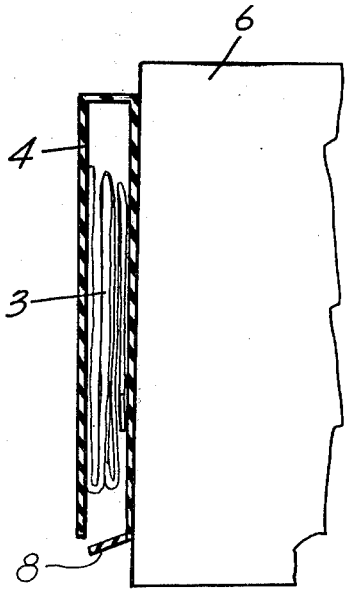
FIG. 4 is a cross-sectional view of the embodiment of FIG. 1 mounted on a shoe.

The shoe shoelace accessory of the invention comprises an extra shoelace 3 (FIG. 4).

In accordance with the invention, an openable container 4 is either permanently or removably affixed to the shoe 1 and houses the extra shoelace 3. The container 4 may be affixed to any desired area of a shoe in any suitable manner.

Figure 2:
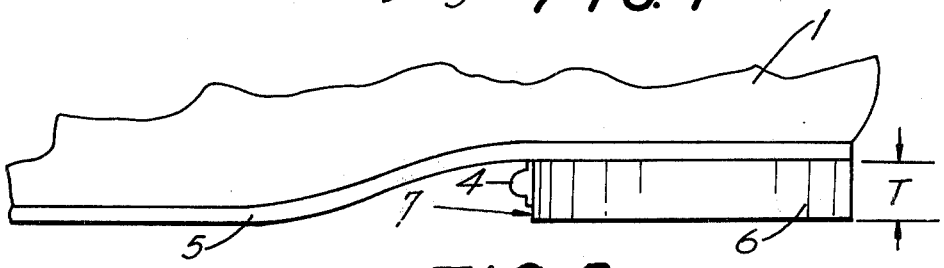
FIG. 2 is a side view of the embodiment of FIG. 1 affixed to a shoe.

The shoe 1 has a bottom 5 and a heel 6. Th heel 6 has a thickness T (FIG. 2) defined by a front surface 7 substantially perpendicular to the bottom 5 and extending a predetermined distance beneath said bottom. In a preferred embodiment of the invention, the container 4 is affixed to the front surface 7 of the heel 6, as shown in the FIGS. A shoelace previously removed from the container may be replaced via the cover 8 thereof (FIG. 4).

Figure 5:
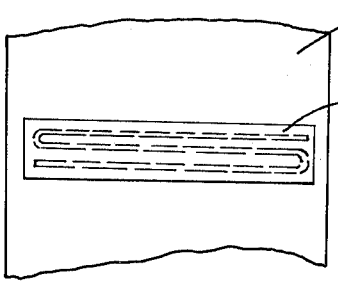
FIG. 5 is a view of another embodiment of the shoe shoelace accessory of the invention on the back of a shoe.
Figure 1:
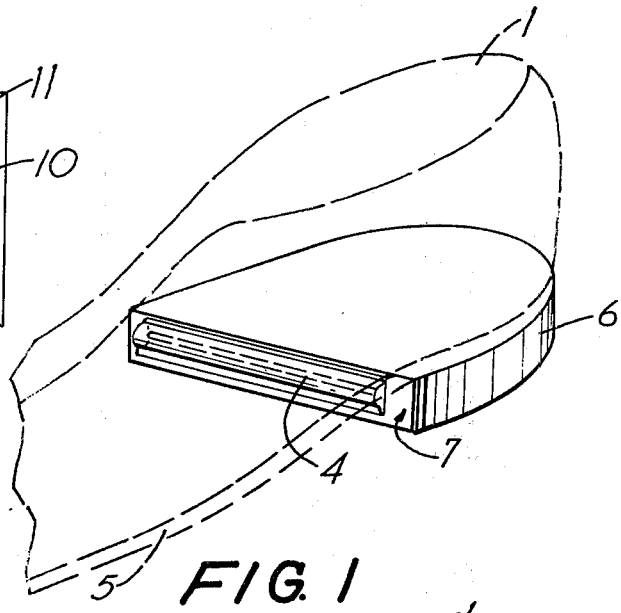
FIG. 1 is a diagram illustrating the positioning of an embodiment of the shoe shoelace accessory of the invention on a shoe.

In the embodiment of FIG. 5, the shoe shoelace accessory of the invention comprises an extra shoelace 9 housed in a container 10 which is either permanently or removably affixed to the back or side of a shoe 11 such as, for example, a sneaker, a workshoe, or tennis shoe, which does not have a heel. The container 10 may be openable.

While the invention has been described by means of a specific example and in a specific embodiment, I do not wish to be limited thereto, for obvious modifications will occur to those skilled in the art without departing from the spirit and scope of the invention.

I claim:

1. A shoelace accessory in combination with a shoe, said shoe having a bottom, a heel having a thickness defined by a front surface substantially perpendicular to the bottom and extending a predetermined distance beneath the bottom of the shoe, a back, a pair of sides and a shoelace, said shoelace accessory comprising a sealed container permanently affixed to the front surface of the heel and having an openable cover; and an extra shoelace housed in the container.

2. A shoelace accessory in combination with a shoe, said shoe having a bottom, a heel having a thickness defined by a front surface substantially perpendicular to the bottom and extending a predetermined distance beneath the bottom of the shoe, a back, a pair of sides and a shoelace, said shoelace accessory comprising a sealed container permanently affixed to one of the back and sides of the shoe.

* * * * *